US010179967B2

(12) United States Patent
Ozdemir et al.

(10) Patent No.: US 10,179,967 B2
(45) Date of Patent: Jan. 15, 2019

(54) HEAT PUMP DRYER

(71) Applicant: ARCELIK ANONIM SIRKETI, Istanbul (TR)

(72) Inventors: Musa Ozdemir, Istanbul (TR); Erkan Ozturk, Istanbul (TR); Mehmet Salih Ocak, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 280 days.

(21) Appl. No.: 15/101,753

(22) PCT Filed: Oct. 24, 2014

(86) PCT No.: PCT/EP2014/072885
§ 371 (c)(1),
(2) Date: Jun. 3, 2016

(87) PCT Pub. No.: WO2015/082125
PCT Pub. Date: Jun. 11, 2015

(65) Prior Publication Data

US 2016/0369448 A1 Dec. 22, 2016

(30) Foreign Application Priority Data

Dec. 3, 2013 (TR) ..... a 2013/14109

(51) Int. Cl.
*D06F 58/20* (2006.01)
*D06F 58/24* (2006.01)
*D06F 25/00* (2006.01)

(52) U.S. Cl.
CPC ..... *D06F 58/206* (2013.01); *D06F 58/24* (2013.01); *D06F 25/00* (2013.01)

(58) Field of Classification Search
CPC ..... D06F 58/206; D06F 58/24
(Continued)

(56) References Cited

U.S. PATENT DOCUMENTS 3,206,950 A * 9/1965 Xeros ..... D06F 43/00 210/337
3,612,616 A * 10/1971 Stewart ..... B65G 53/60 19/107

(Continued)

FOREIGN PATENT DOCUMENTS

DE 4128689 A1 3/1993
DE 102007049959 A1 * 4/2009 ..... D06F 58/22

(Continued)

OTHER PUBLICATIONS

International search report for PCT application No. PCT/EP2014/072885 and references contained therein are considered to be closest material prior art and any additional references cited in the application merely define the general state of the art and/or are duplicative.

(Continued)

*Primary Examiner* — Stephen M Gravini
(74) *Attorney, Agent, or Firm* — Kilpatrick Townsend & Stockton LLP

(57) ABSTRACT

The present invention relates to a dryer (1) comprising a body (2), a tub (3) disposed within the body (2) and wherein the drying processes are performed, an air duct (4) wherein the process air cycle is realized, a fan (5) providing the circulation of the process air, an evaporator (6) that is placed into the air duct (4) and that condenses the humid process air, a condenser (7) that is placed into the air duct (4) and that heats the process air dehumidified at the evaporator (6), a pumping chamber (8) from which the water is discharged and that has a base (9), and a pump (10) that discharges the condensed water accumulating in the pumping chamber (8) and that has supports (11) seated on the base (9) and preventing the suction port from sticking to the base (9).

16 Claims, 4 Drawing Sheets

Figure 1:
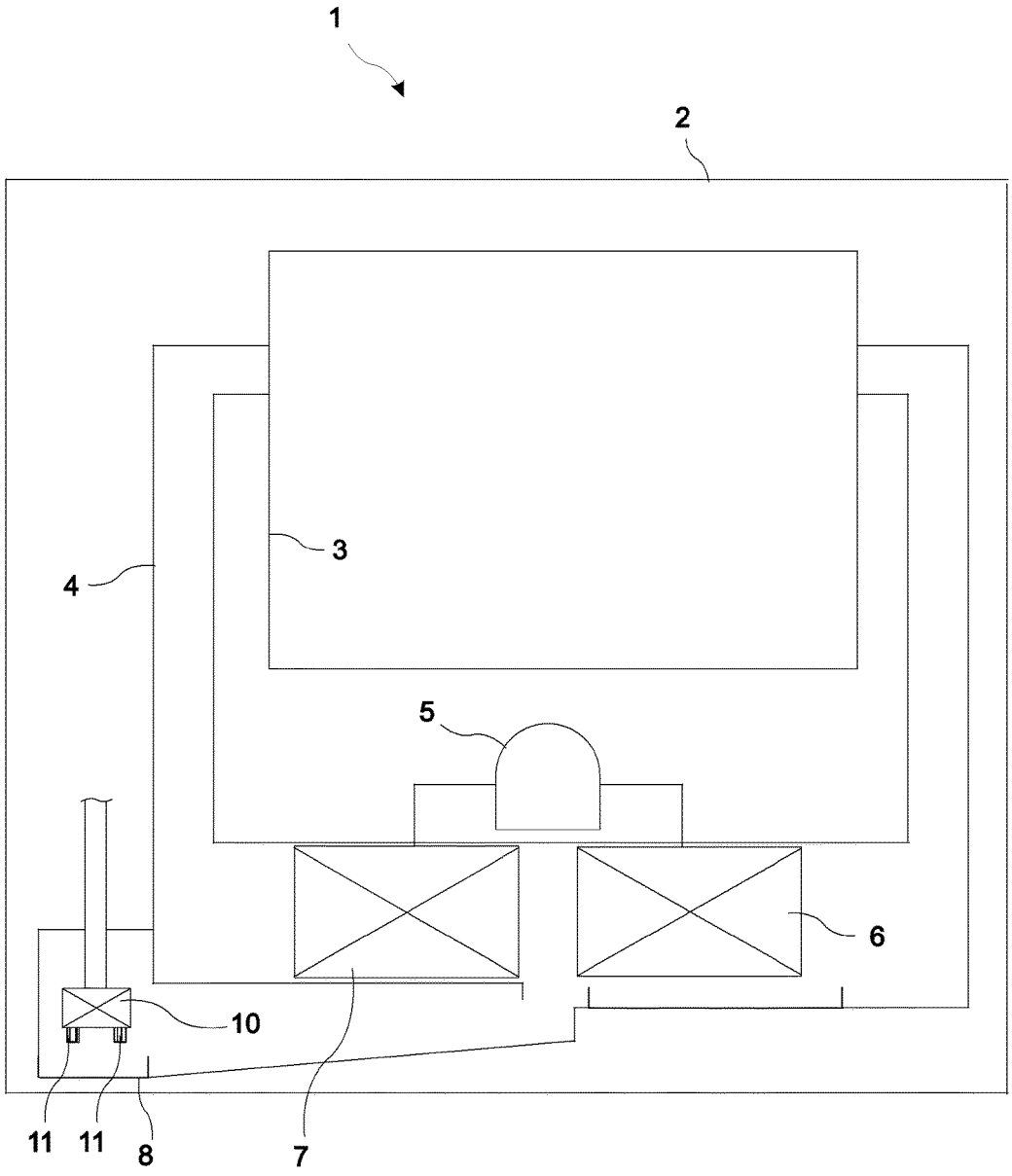

(58) Field of Classification Search
USPC ..... 34/86, 595–610
See application file for complete search history.

(56) References Cited

U.S. PATENT DOCUMENTS 4,603,489 A * 8/1986 Goldberg ..... D06F 58/02 34/605
5,343,632 A * 9/1994 Dinh ..... F26B 21/086 34/507
5,768,730 A * 6/1998 Matsumoto ..... D06F 25/00 210/144
6,691,536 B2 * 2/2004 Severns ..... B01J 20/28033 68/12.27
6,802,137 B1 * 10/2004 Gray ..... F26B 21/145 34/340
6,922,912 B2 * 8/2005 Phillips ..... A47L 15/4291 34/403
7,024,802 B2 * 4/2006 Myung ..... D06F 58/04 34/604
7,677,964 B1 * 3/2010 Bucher ..... F24F 7/025 454/356
7,997,006 B2 * 8/2011 Son ..... D06F 58/04 134/30
8,266,813 B2 * 9/2012 Grunert ..... D06F 58/206 34/595
8,418,378 B2 * 4/2013 Nawrot ..... D06F 58/20 165/287
8,707,581 B2 * 4/2014 Quaroni ..... D06F 39/12 34/604
8,869,421 B2 * 10/2014 Kim ..... D06F 25/00 34/381
9,200,841 B2 * 12/2015 Heo ..... D06F 58/02
9,249,538 B2 * 2/2016 Bison ..... D06F 58/24
9,488,412 B2 * 11/2016 Yu ..... F26B 25/005
9,617,680 B2 * 4/2017 Kitayama ..... D06F 58/24
9,702,080 B2 * 7/2017 Lee ..... D06F 58/04
9,731,865 B2 * 8/2017 He.beta. ..... B65D 25/14
9,803,313 B2 * 10/2017 Ryoo ..... D06F 58/28
9,873,974 B2 * 1/2018 Coniguardi ..... D06F 58/02
9,879,372 B2 * 1/2018 Wakizaka ..... D06F 58/206
9,896,797 B2 * 2/2018 Shin ..... D06F 58/02
9,945,065 B2 * 4/2018 Nam ..... D06F 58/02
9,951,464 B2 * 4/2018 Lee ..... D06F 58/22
2003/0089138 A1 * 5/2003 Kawamura ..... D06F 25/00 68/17 R
2008/0276656 A1 11/2008 Kitamura et al.
2011/0277334 A1 * 11/2011 Lee ..... D06F 58/203 34/73
2016/0369448 A1 * 12/2016 Ozdemir ..... D06F 58/206
2017/0342643 A1 * 11/2017 Miao ..... D06F 29/005
2017/0343284 A1 * 11/2017 Miao ..... F25B 30/02
2017/0350064 A1 * 12/2017 Shin ..... D06F 58/22

FOREIGN PATENT DOCUMENTS

DE 102015209113 A1 * 12/2015 ..... F26B 25/005
EP 2050862 A1 * 4/2009 ..... D06F 58/22
EP 2458074 A1 5/2012
EP 3023531 A1 * 5/2016 ..... D06F 58/24
EP 3252218 A1 * 12/2017 ..... D06F 29/005
JP 2007143611 A 6/2007
JP 2008067996 A 3/2008
JP 2009247600 A 10/2009
JP 2014140439 A 8/2014
WO 2010090411 A1 8/2010
WO 2012146533 A2 11/2012
WO 2012146534 A2 11/2012

OTHER PUBLICATIONS

Written opinion of the international searching authority for PCT application No. PCT/EP2014/072885 and references contained therein are considered to be closest material prior art and any additional references cited in the application merely define the general state of the art and/or are duplicative.
International search report and written opinion, dated Mar. 24, 2015, of International Application No. PCT/EP2014/072885; 9 pgs.

* cited by examiner

HEAT PUMP DRYER

The present invention relates to a heat pump dryer.

In heat pump laundry dryers wherein closed cycle drying process is applied, the heat pump used for drying the laundry is composed of heat exchangers named as evaporator and condenser. The laundry-drying process is performed by passing hot and dry air over the laundry. Humid air leaving the laundry leaves its moisture while passing over the evaporator that works as the condenser and warms while passing over the condenser that works as the heater. The air that leaves its moisture and warms up is sent onto the laundry throughout the drying cycle. The humid air condensing on the evaporator fins trickles down as water droplets due to the effect of the gravity and these droplets accumulate in the collection chamber under the evaporator. The condensed water in the collection chamber is sent to the pumping chamber to be discharged by means of the flow channel and discharged from here via the discharge pump. The discharge pump has supports and remains above the surface of the pumping chamber so that the suction port does not stick to the base of the pumping chamber with the vacuum effect. Due to the supports, it becomes difficult to entirely discharge the water in the pumping chamber and the discharge pump may pump air instead of water. Moreover, the water accumulating at the base of the pumping chamber causes the generation of undesired bad odors.

In the Patent Application No. JP2009247600, a laundry dryer is explained, wherein the discharge of the water condensing in the evaporator is facilitated.

In the Patent Applications No. WO2012146533 and WO2012146534, a dryer is explained having an air guide that enables the process air to be directed.

The aim of the present invention is the realization of a dryer wherein the drying efficiency is increased and generation of undesired bad odors is prevented by facilitating the discharge of the condensate water.

The dryer realized in order to attain the aim of the present invention, explicated in the first claim and the respective claims thereof comprises a pump that is used to discharge the condensed water and that has supports preventing the suction port from sticking to the surface whereon it is seated, and a pumping chamber that has a base at least one portion of which is at a higher level than the level of the suction port of the pump. The amount of water being pumped is increased thanks to the relative position of the pump which is lower with respect to the base.

In an embodiment of the present invention, at least one portion of the base is inclined towards the surface whereon the supports are seated. In this embodiment, the water is enabled to flow towards the pump instead of accumulating on the base.

In an embodiment of the present invention, the base is shaped as a shell that is almost semi-spherical. The production of the base shaped as an almost semi-spherical shell is easier and by means of the said base, the water flow becomes more stable and the amount of water accumulating on the base is decreased.

In an embodiment of the present invention, the dryer comprises the base having a cavity wherein the supports are seated. By forming a cavity on the base wherein the pump is intended to be seated, the amount of water in the pumping chamber that cannot be discharged is tremendously decreased.

The dryer of the present invention also performs the function of washing laundry.

In the dryer of the present invention, thanks to the base at least one portion of which is higher than the suction port of the pump, the condensed water is prevented from accumulating in the pumping chamber and is enabled to be almost entirely discharged. Moreover, in the dryer of the present invention the necessity of the pump standing on supports is maintained.

The dryer realized in order to attain the aim of the present invention is illustrated in the attached figures, where:

FIG. 1—is the schematic view of a dryer.

Figure 2:
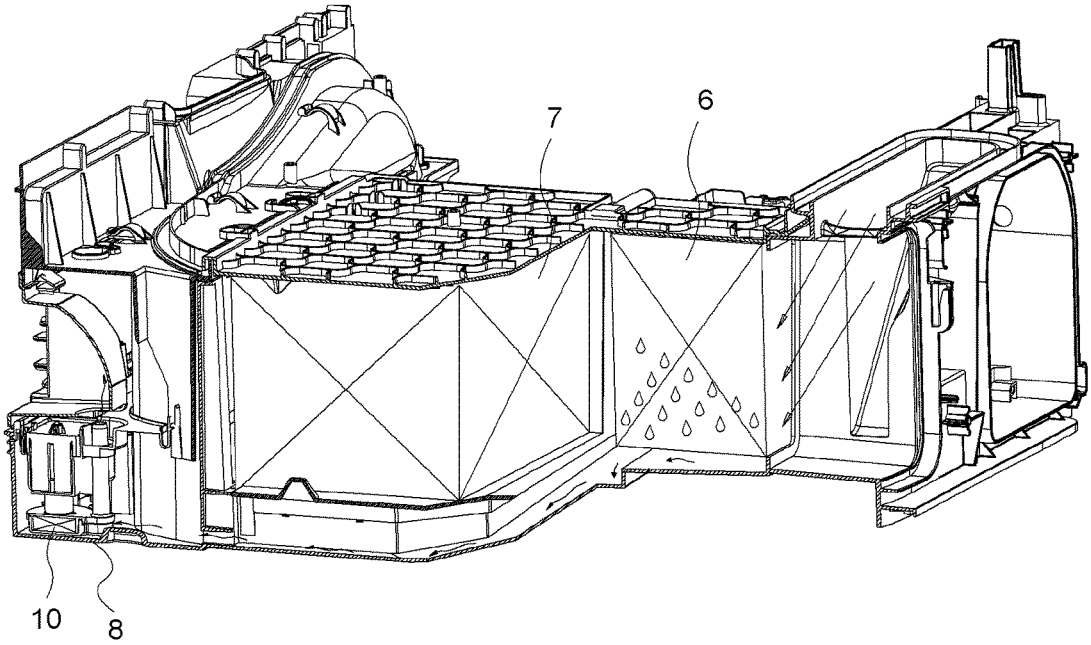

FIG. 2—is the partial perspective view of a dryer.

Figure 3:
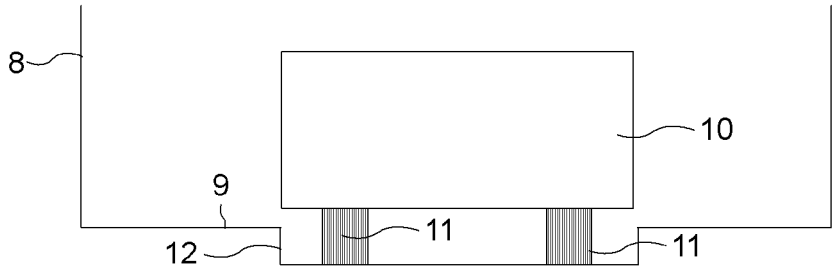

FIG. 3—is the schematic view of the pumping chamber in an embodiment of the present invention.

Figure 4:
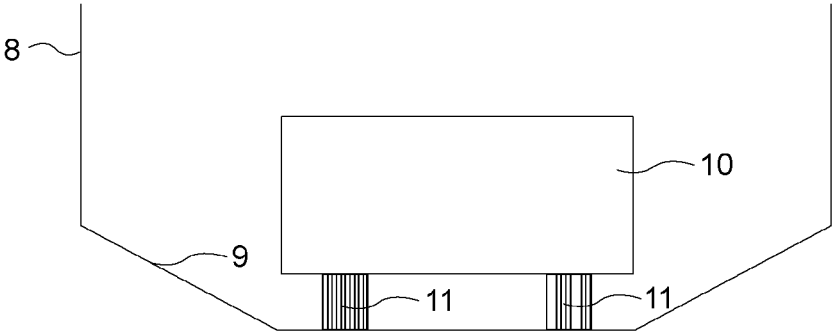

FIG. 4—is the schematic view of the pumping chamber in another embodiment of the present invention.

Figure 5:
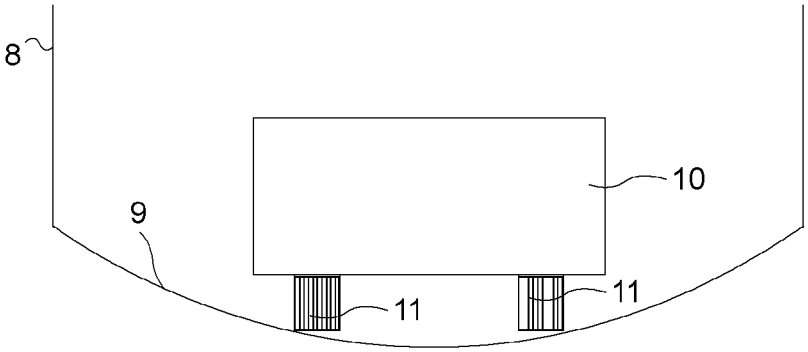

FIG. 5—is the schematic view of the pumping chamber in another embodiment of the present invention.

Figure 6:
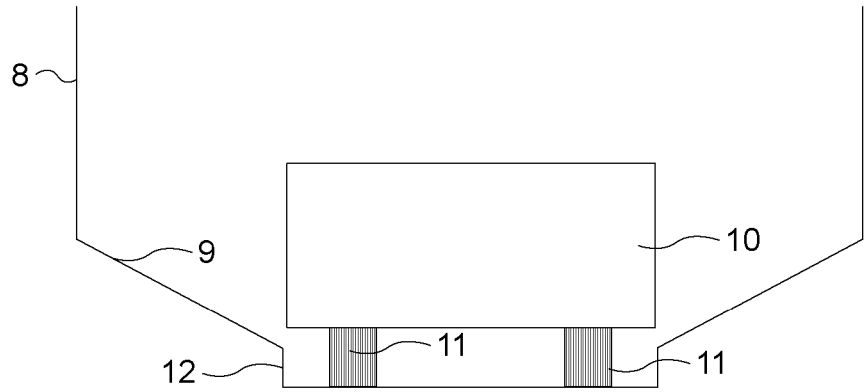

FIG. 6—is the schematic view of the pumping chamber in another embodiment of the present invention.

Figure 7:
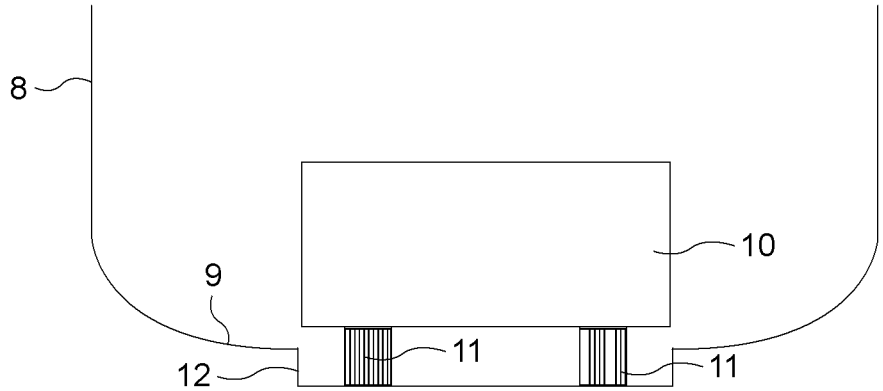

FIG. 7—is the schematic view of the pumping chamber in another embodiment of the present invention.

The elements illustrated in the figures are numbered as follows:

1. Dryer
2. Body
3. Tub
4. Air duct
5. Fan
6. Evaporator
7. Condenser
8. Pumping chamber
9. Base
10. Pump
11. Support
12. Cavity The dryer (1) comprises a body (2), a tub (3) disposed within the body (2) and wherein the drying processes are performed, an air duct (4) wherein the process air cycle is realized, a fan (5) providing the circulation of the process air, an evaporator (6) that is placed into the air duct (4) and that condenses the humid process air, a condenser (7) that is placed into the air duct (4) and that heats the process air dehumidified at the evaporator (6), a pumping chamber (8) from which the water is discharged and that has a base (9), and a pump (10) that discharges the condensed water accumulating in the pumping chamber (8) and that has supports (11) seated on the base (9) and preventing the suction port from sticking to the base (9).

In the dryer (1), the fan (5) realizes the process air cycle. The process air becomes humid while passing over the laundry and the humid air is enabled to be condensed by being delivered to the evaporator (6). The water condensing on the evaporator (6) is transferred to the pumping chamber (8). The condensed process air is heated by being passed through the condenser (7) and is delivered into the tub (3) again. The water accumulating in the pumping chamber (8) is discharged by means of the pump (10). The pump (10) has more than one support (11) that prevents the suction port from sticking to the base (9) of the pumping chamber (8) with the vacuum effect.

In the dryer (1) of the present invention, at least one portion of the base (9) is at a level higher than the level of the suction port of the pump (10). By means of the base (9) that is higher than the suction port of the pump (10), the amount of water discharged by the pump (10) is increased and the amount of water accumulating in the pumping chamber (8) is decreased.

In an embodiment of the present invention, in the dryer (1) at least one portion of the base (9) is inclined towards the surface whereon the supports (11) are seated. By means of the inclined base (9), it becomes easier for the water to flow towards the suction port of the pump (10) and the water is prevented from accumulating in the pumping chamber (8).

In an embodiment of the present invention, in the dryer (1) the base (9) is shaped as a shell that is almost semi-spherical. By means of the base (9) shaped as an almost semi-spherical shell, the water is enabled to flow towards the suction port of the pump (10) and the water is prevented from accumulating in the pumping chamber (8).

In an embodiment of the present invention, the dryer (1) comprises the base (9) having a cavity (12) wherein the supports (11) are seated. Thus, when water accumulates in the pumping chamber (8), the water is enabled to accumulate in the cavity (12), increasing the amount of discharged water.

In an embodiment of the present invention, the dryer (1) also has the function of washing laundry.

In the dryer (1) of the present invention, the base (9) is designed so as to maximize the amount of water to be discharged. In the dryer (1) of the present invention, a large portion of the condensed water is discharged at the end of the drying process and the water accumulating in the pumping chamber (8) is prevented from generating bad odors. Moreover, bacteria formation in the pumping chamber (8) is reduced.

The invention claimed is:

1. A dryer comprising:

a body;

a tub disposed within the body and wherein drying processes are performed;

an air duct coupled to the tub and through which process air cycles;

a fan providing circulation of the process air through the air duct and the tub;

an evaporator disposed within the air duct and that generates condensed water by condensing the process air to remove humidity from the process air;

a condenser disposed within the air duct and that heats the process air that was condensed at the evaporator; and a pumping chamber coupled to the air duct and in which the condensed water accumulates and from which the condensed water is discharged, the pumping chamber comprising:

a base, and a pump that discharges the condensed water accumulating in the pumping chamber and that has supports seated on the base, wherein the supports prevent a suction port of the pump from sticking to the base, wherein at least one portion of the base is at a first level and the suction port of the pump is at a second level that is lower than the first level.

2. The dryer of claim 1, wherein the supports are seated on a first portion of the base and wherein a second portion of the base is inclined towards the first portion of the base.

3. The dryer of claim 1, wherein the base is shaped as a semi-spherical shell.

4. The dryer of claim 1, wherein the supports are seated within a cavity of the base.

5. The dryer of claim 1, wherein the dryer is configured to wash laundry.

6. The dryer of claim 2, wherein the base is shaped as a semi-spherical shell.

7. The dryer of claim 2, wherein the supports are seated within a cavity of the base.

8. The dryer of claim 2, wherein the dryer is configured to wash laundry.

9. The dryer of claim 3, wherein the supports are seated within a cavity of the base.

10. The dryer of claim 6, wherein the supports are seated within a cavity of the base.

11. The dryer of claim 3, wherein the dryer is configured to wash laundry.

12. The dryer of claim 4, wherein the dryer is configured to wash laundry.

13. The dryer of claim 6, wherein the dryer is configured to wash laundry.

14. The dryer of claim 7, wherein the dryer is configured to wash laundry.

15. The dryer of claim 9, wherein the dryer is configured to wash laundry.

16. The dryer of claim 10, wherein the dryer is configured to wash laundry.

* * * * *